US011994299B2

(12) United States Patent
Hood

(10) Patent No.: US 11,994,299 B2
(45) Date of Patent: May 28, 2024

(54) OVEN SPLATTER GUARD

(71) Applicant: Andrew Hood, Nottinghamshire (GB)

(72) Inventor: Andrew Hood, Nottinghamshire (GB)

( * ) Notice: Subject to any disclaimer, the term of this patent is extended or adjusted under 35 U.S.C. 154(b) by 0 days.

(21) Appl. No.: 16/337,268

(22) PCT Filed: Sep. 27, 2017

(86) PCT No.: PCT/GB2017/052890
§ 371 (c)(1),
(2) Date: Mar. 27, 2019

(87) PCT Pub. No.: WO2018/060699
PCT Pub. Date: Apr. 5, 2018

(65) Prior Publication Data

US 2019/0331343 A1 Oct. 31, 2019

(30) Foreign Application Priority Data

Sep. 27, 2016 (GB) ..... 1616390

(51) Int. Cl.
*F24C 15/12* (2006.01)

(52) U.S. Cl.
CPC ..... *F24C 15/12* (2013.01)

(58) Field of Classification Search
CPC .... A21B 3/13; A21B 5/03; A21B 1/22; A21B 1/48; F24D 17/0021; F24D 2200/14; F24C 15/12; F24C 11/00; F24C 15/006; F24C 15/105; F24C 15/20; F24C 15/2007; F24C 15/2042; F24C 15/2057; F24C 15/32; A47J 31/407; A47J 27/04; A47J 36/022; A47J 2027/043; A47J 36/321; A47J 37/0786; A47J 37/1219; A47J 37/128; A47J 37/1295; A47J 27/12; A47J 31/22; A47J 36/025; A47J 36/04; A47J 37/01; A47J 37/106; A47J 37/1209; A47J 37/1223; A47J 37/1266; A47J 27/002; A47J 27/10; A47J 36/06; A47J 36/165; A47J 37/043; A47J 37/047; A47J 37/049; A47J 37/0641; A47J 37/0664; A47J 37/108; A47J 37/1228; A47J 37/1261; A47J 37/1271; A47J 37/1285; A47J 43/04; A47J 43/046; A47J 43/07; A47J 43/288; A47J 44/00; A47J 47/005;
(Continued)

(56) References Cited

U.S. PATENT DOCUMENTS 2,568,276 A 9/1951 Eggleston
3,192,917 A 7/1965 Baert
(Continued)

FOREIGN PATENT DOCUMENTS

EP 0989259 A2 3/2000
GB 2459150 A * 10/2009 ..... E04H 15/40
(Continued)

OTHER PUBLICATIONS

"Wrought Aluminum". Atlas of Stress-Strain Curves (Year: 2002).*
(Continued)

*Primary Examiner* — Jason Lau

(57) ABSTRACT

An oven splatter guard comprising: a flexible screen configured to at least reduce splatter in a working oven wherein the flexible screen is not self-supporting; and a collapsible support means configured to support the flexible screen.

18 Claims, 2 Drawing Sheets

(58) Field of Classification Search

CPC ..... A47J 47/16; A47J 2037/0777; A47J 2037/0795; A47J 2043/04436; A47J 27/004; A47J 27/0813; A47J 27/13; A47J 27/14; A47J 31/405; A47J 31/4489; A47J 36/16; A47J 36/2433; A47J 36/2483; A47J 36/32; A47J 37/041; A47J 37/06; A47J 37/0629; A47J 37/0688; A47J 37/0694; A47J 37/0704; A47J 37/0754; A47J 37/0763; A47J 37/101; A47J 37/1204; A47J 37/1214; A47J 37/129; A47J 41/0094; A47J 43/042; A47J 43/044; A47J 43/0465; A47J 43/0716; A47J 43/0766; A47J 43/0772; A47J 43/08; A47J 43/082; A47J 43/12; A47J 43/18; A47J 47/01

See application file for complete search history.

(56) References Cited

U.S. PATENT DOCUMENTS

| | | | | |
|---|---|---|---|---|
| 4,037,581 | A | 7/1977 | Trifiletti | |
| 4,422,441 | A | 12/1983 | Schoepe | |
| 4,527,540 | A | 7/1985 | Ryan et al. | |
| 4,979,236 | A * | 12/1990 | Merrill | A01K 55/00 2/202 |
| 5,809,989 | A | 9/1998 | Nelson | |
| 5,927,266 | A | 7/1999 | Maugard | |
| 2002/0179083 | A1 | 12/2002 | Hoshowski | |
| 2005/0005779 | A1 * | 1/2005 | Morgan | A21B 3/13 99/426 |
| 2008/0223425 | A1 | 9/2008 | Shumate | |
| 2011/0108078 | A1 * | 5/2011 | Roman | E04H 15/001 135/121 |
| 2013/0273847 | A1 | 10/2013 | Le et al. | |
| 2015/0013661 | A1 | 1/2015 | Reischmann | |
| 2016/0208513 | A1 * | 7/2016 | Ways | E04H 15/44 |
| 2017/0226769 | A1 * | 8/2017 | Cruz | E04H 15/48 |

FOREIGN PATENT DOCUMENTS

| | | | |
|---|---|---|---|
| JP | S63108129 | A | 5/1988 |
| JP | 2009293902 | A | 12/2009 |
| JP | 2012107850 | A | 6/2012 |
| WO | 2011070378 | A3 | 10/2011 |
| WO | 2016066541 | A1 | 5/2016 |

OTHER PUBLICATIONS

United Kingdom Application No. GB1616390.9, Combined Search and Examination Report, dated Mar. 13, 2017, 7 pages.

PCT Application No. PCT/GB2017/052890, International Search Report and Written Opinion, dated Nov. 20, 2017, 13 pages.

* cited by examiner

OVEN SPLATTER GUARD

TECHNOLOGICAL FIELD

Embodiments of the present invention relate to an oven splatter guard. In particular, they relate to an oven splatter guard for reducing splatter in a working oven.

BACKGROUND

Meat or other foods cooked in an oven comprises fluids such as, for example, oils, water, cell plasma. At normal temperature in a working oven the fluids will vaporise. The rapid transition of the fluid to gas causes matter to be projected from the meat or other foods. When the matter impacts on the infernal surfaces of the oven it creates splatter. An oven cannot be cleaned for some time after use while it cools and it can be difficult to clean the internal surfaces of the oven.

BRIEF DESCRIPTION

For a better understanding of various examples that are useful for understanding the detailed description, reference will now be made by way of example only to the accompanying drawings in which.

BRIEF SUMMARY

Figure 1A:
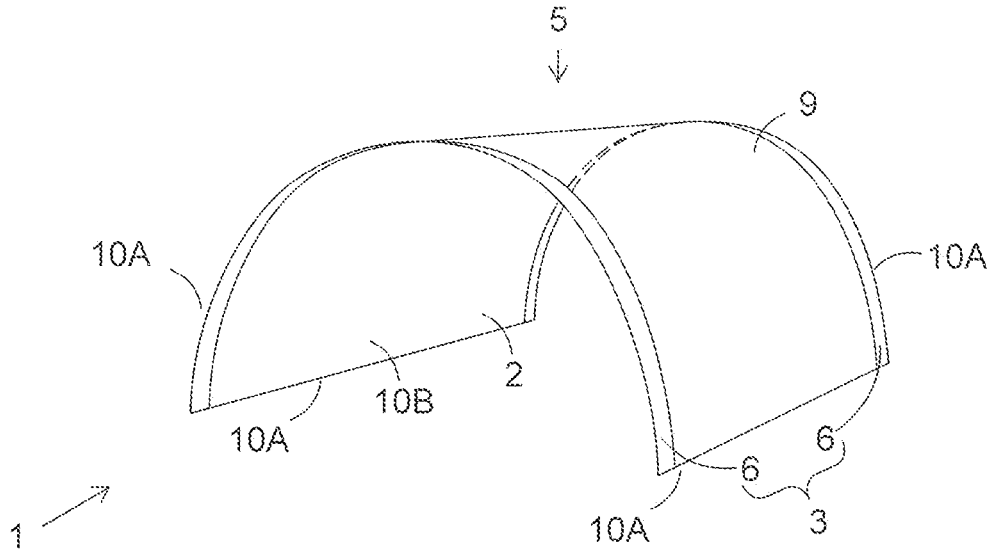
FIG. 1A and 1B illustrate an example of on oven splatter guard in an erected configuration and a collapsed configuration.

According to various, but not necessarily all examples of the present disclosure there is provided an oven splatter guard comprising: a flexible screen configured to at least reduce splatter in a working oven wherein the flexible screen is not self-supporting; and a collapsible support means configured to support the flexible screen.

According to various, but not necessarily all examples of the present disclosure the collapsible support means is configured to be arranged in a collapsed configuration of the oven splatter guard and at least one stable erected configuration of the oven splatter guard, wherein the oven splatter guard, in the at least one stable erected configuration, is configured to fit within a domestic oven.

According to various, but not necessarily all examples of the present disclosure the collapsible support means is configured to be arranged in a plurality of erected configurations of the oven splatter guard.

According to various, but not necessarily all examples of the present disclosure the collapsible support means is configured to be arranged in a continuous set of the plurality of stable erected configurations of the oven splatter guard.

According to various, but not necessarily all examples of the present disclosure the collapsible support means is configured to be arranged in a discrete set of the plurality of stable erected configurations of the oven splatter guard.

According to various, but not necessarily all examples of the present disclosure the collapsible support means is configured to provide only one stable erected configuration.

According to various, but not necessarily all examples of the present disclosure the collapsible support means comprises a plurality of support elements.

According to various, but not necessarily all examples of the present disclosure one or more of the plurality of support elements are configured to be decoupled from the flexible screen.

According to various, but not necessarily all examples of the present disclosure the plurality of support elements comprise one or more bendable poles.

According to various, but not necessarily all examples of the present disclosure the bendable pole is configured to remain in a first bent state until bent into a second bent shape by a user.

According to various, but not necessarily all examples of the present disclosure the one or more bendable poles comprise resiliently bendable poles.

According to various, but not necessarily all examples of the present disclosure the plurality of support elements comprise a tie between two ends of one of the resiliently bendable poles in order to provide the at least one stable erected configuration.

According to various, but not necessarily all examples of the present disclosure the length of the tie between the two ends is adjustable to provide a plurality of stable erected configurations.

According to various, but not necessarily all examples of the present disclosure one or more of the plurality of support elements are integral with the flexible screen.

According to various, but not necessarily all examples of the present disclosure one or more first support elements are coupled to the flexible screen and one or more second support elements are coupled to the flexible screen, wherein the one or more second support elements are parallel to the one or more first support elements and separated by at least a portion of the flexible screen such that in the at least one stable erected configuration the oven splatter guard is formed as a tunnel.

According to various, but not necessarily all examples of the present disclosure one or more first support elements are coupled to the flexible screen and one or more second support elements are coupled to the flexible screen, wherein the one or more second support elements cross the one or more first support elements such that in the at least one stable erected configuration the oven splatter guard is formed as a dome.

According to various, but not necessarily all examples of the present disclosure the flexible screen comprises a mesh.

According to various, but not necessarily all examples of the present disclosure the mesh is sized to substantially prevent penetration by projectile matter.

According to various, but not necessarily all examples of the present disclosure the mesh is continuously heat resistant to at least 100 degrees Celsius.

According to various, but not necessarily all examples of the present disclosure the mesh is a Teflon®-coated fibreglass mesh.

According to various, but not necessarily all, embodiments of the invention there may be provided examples as claimed in the appended claims.

DETAILED DESCRIPTION

The figures illustrate an oven splatter guard 1 comprising a flexible screen 2 configured to reduce splatter in a working oven, wherein the flexible screen 2 is not self-supporting, and a collapsible support means 3 configured to support the flexible screen 2.

The oven splatter guard 1 is configured for use in domestic ovens. The oven splatter guard 1 is configured for use in gas ovens, electric ovens, and/or microwave ovens. In some examples within the scope of this disclosure, the over splatter guard may be used in industrial ovens.

As used herein splatter may comprise matter projected from meat or other foods during cooking in an oven. In some examples the matter comprises, without limitation, any of: food waste, fat, oil, water, cell plasma.

As illustrated in the figures, the flexible screen 2 comprises at least a portion of a sheet of material 10. In some examples the sheet of material 10 is rectangular. In some but not necessarily all examples the sheet of material is impermeable and configured to prevent, whilst undamaged, the passage of projectile matter therethrough. In some but not necessarily all examples, the sheet of material comprises a mesh 9. The apertures of the mesh 9 are sized to substantially prevent passage therethrough by projectile matter such as, for example, fat or oil projected from meat or other foods during cooking in an oven. In some examples the apertures of the mesh 9 are sized to enable sufficient heat circulation for the meat or other foods to cook. In some examples the apertures of the mesh 9 are sized in the range of 0.01-100 sq. mm or 0.01-1 sq. mm or 1-100 sq. mm or 0.25 sq. mm-1 sq. mm or 1-25 sq. mm. In some examples the sheet of material has dimensions of between 40-70 cm by between 40-70 cm.

In some examples the mesh 9 comprises a polytetrafluoroethylene coating.

In some examples, the mesh 9 is a Teflon®-coated fibreglass mesh. The Teflon®-coated fibreglass mesh is continuously heat resistant to 260 degrees Celsius. It is to be understood that continuously heat resistant to a specified temperature means heat resistant at the specified temperature indefinitely, however, for shorter time periods, higher temperatures can be resisted. The Teflon®-coated fibreglass mesh is continuously heat resistant to normal working temperatures in a domestic oven and Teflon®-coated fibreglass mesh may be replaced in the oven splatter guard 1 by any suitable mesh. It may, for example, be a silicon-based mesh or a stainless steel mesh. In some examples the mesh 9 is continuously heat resistant to at least 100 degrees Celsius. In some examples the mesh 9 is continuously heat resistant to 100 degrees Celsius or to 300 degrees Celsius or to any other temperature between 100 and 300 degrees Celsius such as, for example, 260 degrees Celsius. In some examples the mesh may be continually heat resistant to temperatures exceeding 300 degrees Celsius. In some examples the mesh 9 has a high specific heat capacity and therefore. In some examples the mesh 9 is configured to cool quickly when heat is not applied. In some examples the mesh 9 is coated in a black finish such that discoloration that occurs over time due to heat intensity is less visible than with other colours.

In some examples, the flexible screen 2 is continuously heat resistant.

Heat resistant materials are able to maintain their properties when exposed to high temperatures such as, for example, those given in the preceding paragraph. Continuously heat resistant materials are thus those materials which can be exposed to a specified temperature indefinitely without alteration to their material properties. In the case of the flexible screen 2, its continuous heat resistance means that its flexibility is at least substantially, and in some examples entirely, maintained even after repeated exposure to high temperatures, such as for example those experienced in a working oven.

The oven splatter guard 1 comprising the flexible screen 2 is therefore suitable for repeated use in a working oven. The oven splatter guard 1 is re-usable.

The flexible screen 2 of the oven splatter guard 1 does not need to be replaced after each use in an oven. The flexible screen 2 of the oven splatter guard 1 does not need to be replaced after, for example, three uses or less or after five uses or less or after ten uses or less. The oven splatter guard 1 can, in some examples, be used in a working oven on more than ten occasions or on more than 15 occasions or on more than 20 occasions without requiring replacement of the flexible screen 2 with another flexible screen 2. It is to be appreciated that the oven splatter guard 1 may be suitable for use on considerably more occasions without requiring replacement of the flexible screen 2 including, for example, daily use over a period of one or more years.

In some examples, the flexible screen 2 alone will not retain a shape. The flexible screen 2 will not remain in a shape without additional support from the collapsible support means 3 or any other suitable means for support. The flexible screen 2 will not remain in any shape other than a flat plane without additional support from the collapsible support means 3 or any other suitable means for support. The flexible screen 2 will not remain in a flat plane without sufficient tension being exerted around its perimeter by a means for support or without sufficient points of contact with a means for support over the surface area of the flexible screen 2.

As illustrated in FIG. 1A, the collapsible support means 3 is configured to be arranged in at least one stable erected configuration 5 of the oven splatter guard 1. In the at least one stable erected configuration 5 the oven splatter guard 1 is free standing (e.g., does not require attachment to the oven to remain in a stable erected configuration 5) and remains in a first shape until a user arranges the oven splatter guard 1 into a second shape. In the at least one stable erected configuration 5 the oven splatter guard 1 is configured to fit within a domestic oven. In some examples, the collapsible support means 3 may be arranged into other stable configurations which do not fit within a domestic oven. In some examples, these other stable configurations may be other stable erect configurations.

Figure 1B:
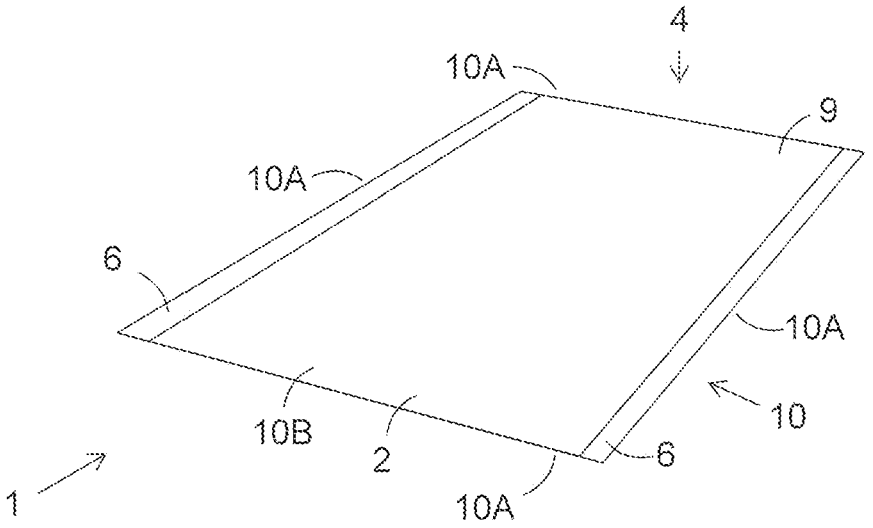

As illustrated in FIG. 1B, the collapsible support means 3 is configured to be arranged in a collapsed configuration 4 of the oven splatter guard 1. In the collapsed configuration 4 the oven splatter guard 1 can be easily and efficiently stored and easily cleaned to remove splatter. By using the oven splatter guard 1 during cooking in an oven, splatter on oven surfaces is reduced. In the collapsed configuration 4 the oven splatter guard 1 is easier to clean than oven surfaces.

In some examples the collapsible support means 3 is configured to provide a plurality of erected configurations 5. The plurality of erected configurations 5 enable the oven splatter guard 1 to be arranged into a shape which fits in a domestic oven and between the meat or other foods being cooked and the interior surfaces of a domestic oven. The plurality of erected configurations 5 enable the height and width of the oven splatter guard 1 to be adjusted. If the meat or other foods being cooked is placed on an upper oven shelf, the height of the oven splatter guard 1 can be reduced.

In some examples the collapsible support means 3 provides a continuous set of the plurality of stable erected configurations 5. In some but not necessarily all of these examples, no fixed relationship exists between the height and the width of the oven splatter guard 1. In other examples the collapsible support means 3 provides a discrete set of the plurality of stable erected configurations 5.

In some examples the collapsible support means 3 comprises a plurality of support elements 6. It is to be appreciated that some of the plurality of support elements 6 may function to support the flexible screen 2 and some of the plurality of support elements 6 may function to enable other support elements 6 to support the flexible screen 2.

In the example illustrated in FIGS. 1A and 1B one or more first support elements 6 are coupled to the flexible screen 2 and one or more second support elements 6 are coupled to the flexible screen 2. The one or more first support elements 6 are disposed parallel to the one or more second support elements 6 and separated by at least a portion of the flexible screen 2 such that in the at least one stable erected configuration 5 the oven splatter guard 1 is formed as a tunnel. In this example the flexible screen 2 comprises at least a central portion 10B of the sheet of material 10.

In some examples, one of the one or more first support elements 6 and one of the one or more second support elements 6 are integral with the flexible screen 2. An example is shown in FIG. 2.

Figure 2:
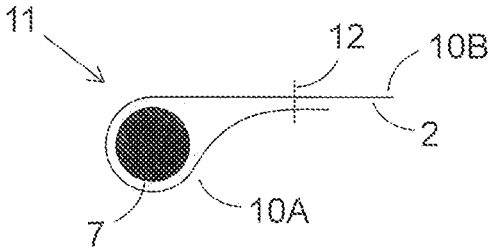
FIG. 2 illustrates an example of at least a portion of a collapsible support means.

As illustrated in FIG. 2, one or more edge portions 10A of the sheet of material 10 are configured as one or more of the plurality of support elements 6. One or more of edge portions 10A (for example the two opposing edge portions 10A defining the openings of the tunnel arrangement shown in FIG. 1A) are configured to form sleeves 11. Each sleeve 11 is configured to receive a further support element 6.

The sleeves 11 are formed from a single sheet of material 10 whereby an open end of an edge portion 10A of the sheet of material 10 is fastened, by means of a fastener 12, to the same sheet of material 10 to form an at least partially enclosed tubular space. The fastener 12 may be Teflon® stitching or one or more staples or any other suitable means. In some examples the sleeve 11 extends along the whole length of the edge portion 10A.

In some examples, a further support element 6 received by a sleeve 11 comprises a bendable pole 7. A bendable pole 7 is flexible. A bendable pole 7 is pliant. Such bendable poles 7 are coupled to the flexible screen 2 by means of the sleeves 11. The circumference of the bendable poles 7 is enclosed by the sleeves 11. In some examples the sleeves 11 are sealed at each end, fully enclosing the bendable poles 7. In other examples the sleeves 11 are open at at least one end such that the bendable poles 7 can be decoupled from the flexible screen 2. The decoupling of the bendable poles 7 enables the sheet of material 10, comprising the flexible screen 2, to be washed separately from the bendable poles 7. The decoupling of the bendable poles 7 from the sheet of material 10 enables the sheet of material 10, comprising the flexible screen 2, to be replaced.

In some examples, where the bendable poles 7 can be decoupled from the flexible screen 2, the bendable poles 7 may be secured to the flexible screen 2 by end caps configured to be fitted to each end of the bendable poles 7 when the bendable poles 7 are received by the sleeves 11. In some examples at least the ends of the bendable poles 7 may be threaded such that a threaded end cap can be screwed onto and unscrewed from the ends of the bendable poles 7. The diameter of the end caps is greater than the diameter of the sleeves 11 such that the end caps cannot be enclosed by the sleeves 11. In some examples the end caps may be spheroid and have a maximum diameter greater than the spacing between the rails of an oven shelf. For example, the spheroid end caps may have a maximum diameter of between 2 cm and 5 cm. In this way the end caps can sit on and between the rails of the oven shelf and provide a stable base for the oven splatter guard 1.

In some but not necessarily all examples, the bendable poles 7 are configured to remain in a first bent state until bent into a second bent shape by a user. The bendable poles 7 are repeatedly deformable into various forms so as to provide a continuous set of the plurality of stable erected configurations 5. The bendable poles 7 can be substantially reverted to a previous form. In some examples the bendable poles 7 comprise aluminium poles.

Figure 3:
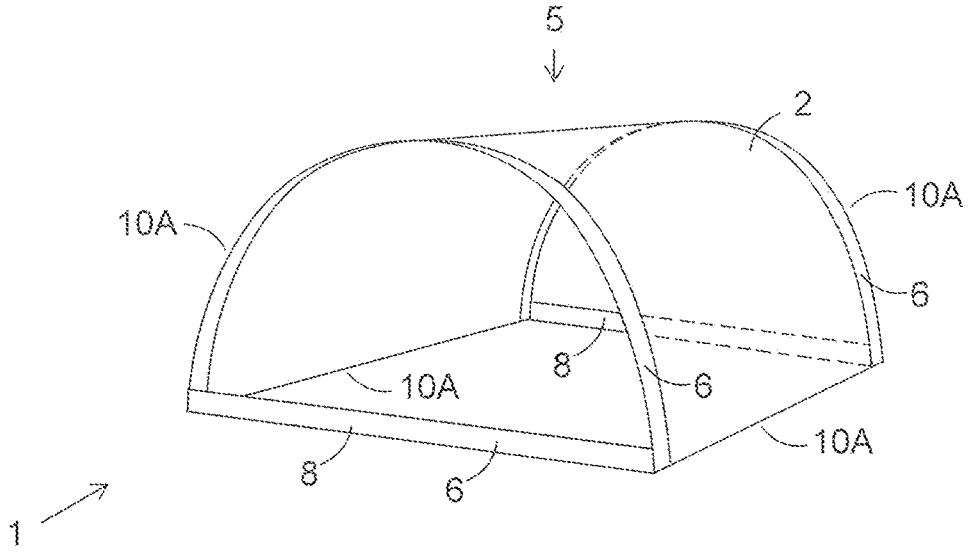
FIG. 3 illustrates a further example of an oven splatter guard.

In other examples a bendable pole 7 comprises a resiliently bendable pole. The resiliently bendable poles remain in a bent state while held in that state and returns to their equilibrium shape when released (e.g., when no longer bent by a user). A further support element 6 is arranged to provide at least one stable erect configuration of the oven splatter guard 1 as illustrated in FIG. 3. In some examples the resiliently bendable poles comprise wire cable such as, for example, steel wire cable.

In some examples an end cap may be fitted to the wire cable to prevent fraying and or to prevent the wire cable from scratching surfaces. In some examples such end caps may not be threaded but may be heat resistant to normal working temperatures in a domestic oven.

In the examples shown in FIG. 3 the plurality of support elements 6 comprise a tie 8 between two ends of one of the resiliently bendable poles in order to provide the at least one stable erected configuration 5. The tie 8 resists tension resulting from the resilience of the resiliently bendable poles. The tie 8 prevents the resiliently bendable pole from returning to an equilibrium state when no longer bent by a user. In some examples a tie 8 is provided for each of the resiliently bendable poles. In some examples, the tie 8 may be a flexible strap. In other examples the tie 8 may be rigid.

In some examples the length of the tie 8 between the two ends of a resiliently bendable pole is adjustable to provide a plurality of stable erected configurations 5. In some examples the tie 8 comprises a plurality of apertures configured to receive therethrough the ends of the resiliently bendable pole so as to provide a discrete set of the plurality of stable erected configurations 5. When the ends of the resiliently bendable pole are disposed through closely spaced apertures, the width of the oven splatter guard 1 is decreased and the height of the oven splatter guard 1 is increased in comparison to when the ends of the resiliently bendable pole are disposed through less closely spaced apertures.

In other examples the length of the tie 8 is adjusted by a rack and pinion system or a ratchet system. The tie 8 comprises a linear rack with teeth and may be coupled to one end of a resiliently bendable pole. A pinion or pawl may be disposed on the other end of the bendable pole 7 in order to adjust the length of the tie 8 between the two ends of a resiliently bendable pole.

In another example the tie 8 comprises a flexible strap and may be coupled to one end of a resiliently bendable pole. A strap adjuster buckle, such as for example a cam buckle, may be disposed on the other end of the bendable pole 7 in order to adjust the length of the tie 8 between the two ends of a resiliently bendable pole so as to provide a continuous set of the plurality of stable erected configurations 5.

Although FIG. 3 has been described in relation to an example in which the support means comprises resiliently bendable poles, it is to be appreciated that the support means may not comprise resiliently bendable poles. In some examples one or more edge portions 10A of the sheet of material 10 are configured as one or more of the plurality of support elements 6. One or more of edge portions 10A (for example the two opposing edge portions 10A defining the openings of the tunnel arrangement shown in FIG. 3) are configured to provide increased stiffness. The one or more edge portions 10A are configured as overlying layers of the material in order to provide increased stiffness. The one or more edge portions 10A are, in some examples, configured as at least 3 overlying layers of the material. In some examples the overlying layers are integral with the flexible screen 2 and are provided by the same sheet of material 10. In some examples the overlying layers of the material are fastened together by means of a fastener. The fastener may be Teflon® stitching or one or more staples or any other suitable means.

The plurality of support elements 6 in these examples further comprise a tie 8 between two locations on the same edge portion 10A configured as overlying layers of the material in order to provide the at least one stable erected configuration 5. In some examples the length of the tie 8 between the two locations is adjustable to provide a plurality of stable erected configurations 5. In some examples the tie 8 comprises a plurality of releasable fasteners configured to couple the tie 8 to at least one location of the two locations on the edge portion 10A and to enable decoupling of the tie 8 from the same. In some examples the tie 8 comprises a plurality of male (or female) halves of a press stud. At least one of the two locations on the edge portion 10A comprises a corresponding female (or male) half of a press stud. In some examples one end of the tie 8 is permanently connected to one location on the edge portion 10A, for example one end of the tie 8 may be formed integrally with the edge portion 10A or may be stitched to the edge portion 10A.

In the examples illustrated by FIGS. 1A and 3 the oven splatter guard 1 is formed as a tunnel with open ends. In some examples additional screens configured to reduce splatter in a working oven may be coupled to the oven splatter guard 1 to substantially seal the open ends of the tunnel. In some examples the additional screens comprise one or more releasable fasteners configured to couple the additional screens to the oven splatter guard 1 and to enable decoupling of the additional screens from the same. The releasable fasteners may be press studs.

Figure 4:
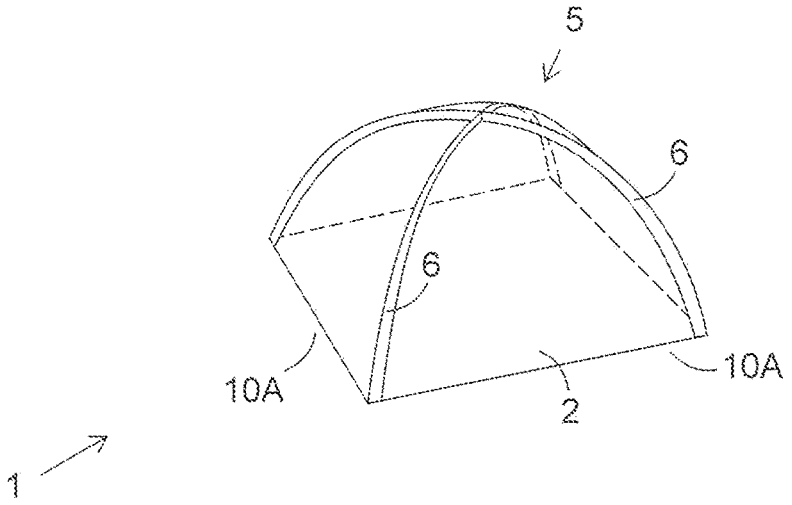
FIG. 4 illustrates a still further example of an oven splatter guard.

In the example illustrated in FIG. 4 one or more first support elements 6 (such as, for example, a bendable pole 7 as shown in FIG. 2) are coupled to the flexible screen 2 and one or more second support element 6 (such as, for example, a bendable pole 7 as shown in FIG. 2) are coupled to the flexible screen 2. The one or more first support elements 6 cross the one or more second support elements 6 such that in the at least one stable erected configuration 5 the oven splatter guard 1 is formed as, for example, a pyramid or a rounded pyramid or a dome.

In the examples illustrated by FIGS. 1A, 3, and 4 one or more edge portions 10A of the sheet of material 10 are configured as the base of the oven splatter guard 1 in each of the at least one stable erected configurations 5. The one or more edge portions 10A are configured as overlying layers of the material to provide increased stiffness to the base.

Figure 5:
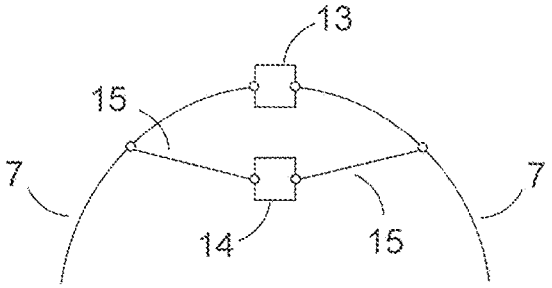
FIG. 5 illustrates a further example of at least a portion of a collapsible support means.

In some examples, such as that illustrated in FIG. 5, the collapsible support means 3 comprises at least two bendable poles 7 pivotally coupled to a first central point 13 of the oven splatter guard 1. In some examples a first end of each bendable pole 7 is pivotally coupled to the first central point 13 by means of a pivot. In some examples the pivot has a single degree of freedom. In some examples a second end of each bendable pole 7 is fixedly coupled to the flexible screen 2.

The collapsible support means 3 further comprises at least two struts 15. The struts 15 are, in some examples, substantially rigid poles configured to resist compression. Each strut 15 is pivotally coupled to a bendable pole 7 at a point between the first end of the bendable pole 7 and the second end of the bendable pole 7 such as, for example, the midpoint of the bendable pole 7. A first end of each strut 15 is pivotally coupled to each bendable pole 7 by means of a pivot. In some examples the pivot has a single degree of freedom. A second end of each strut 15 is pivotally coupled to a second central point 14 by means of a pivot. In some examples the pivot has a single degree of freedom. The second central point 14 is disposed vertically below the first central point 13 and is configured to be moved vertically towards the first central point 13 or vertically away from the first central point 13.

By moving the second central point 14 vertically towards the first central point 13 the vertical component of the length of the struts 15 decreases and correspondingly the horizontal component of the length of the struts 15 increases. As a result, the horizontal distance between the first end and second end of each strut 15 increases and consequently the horizontal distance between the first end and second end of each bendable pole 7 increases such that the collapsible support means 3 expands in a horizontal direction.

By moving the second central point 14 vertically away from the first central point 13 the vertical component of the length of the strut 15 increases and correspondingly the horizontal component of the length of the struts 15 decreases. As a result, the horizontal distance between the first end and second end of each strut 15 decreases and consequently the horizontal distance between the first end and second end of each bendable pole 7 decreases such that the collapsible support means 3 contracts in a horizontal direction.

A locking mechanism, for example a releasable locking mechanism, is provided to prevent the second central point 14 from moving vertically away from the first central point 13 so as to provide at least one stable erected configuration 5 of the oven splatter guard 1. In some examples the locking mechanism is configured to provide only one stable erected configuration 5 of the oven splatter guard 1. In other examples the locking mechanism is configured to provide a plurality of stable erected configurations 5 of the oven splatter guard 1. When the locking mechanism is released, the second central point 14 can be moved vertically away from the first central point 13 so as to provide a collapsed configuration 4 of the oven splatter guard 1.

In some examples the collapsible support means 3 comprises three or more bendable poles 7 pivotally coupled to the first central point 13 and arranged to provide a stable frame for the oven splatter guard 1. Each bendable pole 7 forms a supporting rib for the flexible screen 2. In the at least one stable erected configuration 5 the oven splatter guard 1 is formed as, for example, a pyramid or a rounded pyramid or a dome. In other examples the collapsible support means 3 comprises two or more pairs of bendable poles 7 wherein each pair is pivotally coupled to a different first central point 13. Each pair of bendable poles 7 is separated by at least a portion of the flexible screen 2 such that in the at least one stable erected configuration 5 the oven splatter guard 1 is formed as a tunnel.

In some examples a further sheet of material may be provided. The further sheet of material is configured to overlay the aforementioned flexible screen. The further sheet of material is impermeable and thus prevents, whilst undamaged, the passage of projectile matter therethrough.

The term 'couple' and its derivatives are used in this document to mean directly coupled or indirectly coupled. It should be appreciated that any number or combination of intervening components can exist (including no intervening components). The term 'decouple' and its derivatives are used in this document to mean removable by a user without specific tools.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to 'comprising only one' or by using 'consisting'.

In this brief description, reference has been made to various examples. The description of features or functions in relation to an example indicates that those features or functions are present in that example. The use of the term 'example' or 'for example' or 'may' in the text denotes, whether explicitly stated or not, that such features or functions are present in at least the described example, whether described as an example or not, and that they can be, but are not necessarily, present in some of or all other examples. Thus 'example', 'for example' or 'may' refers to a particular instance in a class of examples. A property of the instance can be a property of only that instance or a property of the class or a property of a sub-class of the class that includes some but not all of the instances in the class. It is therefore implicitly disclosed that a features described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed. For example it is to be appreciated that the shape of the oven splatter guard 1 in a stable erected configuration 5 may be arranged as, without limitation, any of: a cube, a cuboid, a prism, a pyramid, a hemisphere, a tunnel, or a dome.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. An oven splatter guard comprising:

a flexible screen configured to reduce splatter in a working oven wherein the flexible screen is not self-supporting; and a collapsible support means for the flexible screen comprising two bendable poles which each can be bent into various shapes and have the property of remaining, without application of external force, in any one of the various shapes into which they are bent until they are bent into another one of the various shapes by application of external force, wherein bending the two bendable poles into the various shapes provides a continuous set of stable, erected configurations of the oven splatter guard when the two bendable poles are coupled to the flexible screen, and wherein the two bendable poles are decouplable from the flexible screen to provide a collapsed configuration of the oven splatter guard.

2. The oven splatter guard of claim 1, wherein the flexible screen is continuously heat resistant within the working oven.

3. The oven splatter guard of claim 1, wherein at least one of the stable, erected configurations of the oven splatter guard is configured to fit within a domestic oven.

4. The oven splatter guard of claim 1, wherein a first of the two bendable poles is coupled to the flexible screen and a second of the two bendable poles is coupled to the flexible screen, wherein the first and second of the two bendable poles are parallel and separated by at least a portion of the flexible screen such that in the stable, erected configurations the oven splatter guard is formed as a tunnel.

5. The oven splatter guard of claim 1, wherein a first of the bendable poles is coupled to the flexible screen and a second of the two bendable poles is coupled to the flexible screen, wherein the first and second of the two bendable poles cross such that in the stable, erected configuration the oven splatter guard is formed as a dome.

6. The oven splatter guard of claim 1, wherein the flexible screen comprises a mesh.

7. The oven splatter guard of claim 6, wherein the mesh is sized to substantially prevent penetration by projectile matter.

8. The oven splatter guard of claim 6, wherein the mesh is continuously heat resistant to at least 100 degrees Celsius.

9. The oven splatter guard of claim 6, wherein the mesh is a fibreglass mesh.

10. The oven splatter guard of claim 1, wherein portions of the flexible screen are formed as one or more sleeves configured to enable to the coupling and decoupling of the two bendable poles to the flexible screen.

11. The oven splatter guard of claim 1, wherein the two bendable poles are coupled to the flexible screen such that ends of a first of the two bendable pole are not connected to ends of a second of the two bendable poles.

12. The oven splatter guard of claim 4, wherein throughout the continuous set of stable, erected configurations, an area of a base of the tunnel is indirectly related to a height of the tunnel.

13. The oven splatter guard of claim 4, wherein:

a base of the tunnel defines a rectangle that includes a first side and a second side that is perpendicular to the first side, and throughout the continuous set of stable, erected configurations a length of the first side remains constant while a length of the second side is indirectly related to a height of the tunnel.

14. The oven spatter guard of claim 5, wherein throughout the continuous set of stable, erected configurations, an area of a base of the dome is indirectly related to a height of the dome.

15. The oven splatter guard of claim 5, wherein:

a base of the dome defines a square, and throughout the continuous set of stable, erected configurations, a length of a side of the square is indirectly related to a height of the dome.

16. The oven splatter guard of claim 1, wherein each of the two bendable poles have the property of remaining, without continued application of external force, in the other one of the various shapes until further bent into yet another one of the various shapes by further application of external force or until further bent into a previously maintained one of the various shapes by further application of external force.

17. The oven splatter guard of claim 1, wherein each of the two bendable poles are configured to remain in any one of the various shapes without contacting the flexible screen.

18. The oven splatter guard of claim 1, wherein each of the two bendable poles are configured to remain in any one of the various shapes and thereby provide any one of the continuous set of stable, erected configurations in a presence of gravity.

* * * * *